US011492929B1

(12) United States Patent
Aguilar Cuéllar et al.

(10) Patent No.: US 11,492,929 B1
(45) Date of Patent: Nov. 8, 2022

(54) COMBUSTION CAN LIFT ASSEMBLY

(71) Applicant: General Electric Company, Schenectady, NY (US)

(72) Inventors: Artemio Josue Aguilar Cuéllar, Queretaro (MX); Benigno Camacho Mendoza, Queretaro (MX); Alejandro Perez, Queretaro (MX); Alston Ilford Scipio, Mableton, GA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/379,072

(22) Filed: Jul. 19, 2021

(51) Int. Cl.
*F01D 25/28* (2006.01)

(52) U.S. Cl.
CPC ..... *F01D 25/285* (2013.01); *F05D 2220/32* (2013.01); *F05D 2230/64* (2013.01); *F05D 2230/70* (2013.01)

(58) Field of Classification Search
CPC ..... F01D 25/28; F01D 25/285; F23R 3/60; F05D 2220/32; F05D 2230/64; F05D 2230/68; B23P 19/12; B23P 19/10; B23P 19/04
See application file for complete search history.

(56) References Cited

U.S. PATENT DOCUMENTS

| | | | |
|---|---|---|---|
| 5,911,680 | A | 6/1999 | Takeoka |
| 8,713,776 | B2 | 5/2014 | Herbold |
| 8,782,865 | B2 | 7/2014 | Gerengi |
| 10,174,637 | B2 | 1/2019 | Imfeld et al. |
| 10,208,627 | B2 | 2/2019 | Heard et al. |
| 10,934,893 | B2 | 3/2021 | Kolvick et al. |
| 2014/0123656 | A1* | 5/2014 | Sancewich ..... F02C 7/00 60/752 |
| 2016/0363323 | A1 | 12/2016 | Mogle et al. |
| 2017/0167298 | A1 | 6/2017 | Kolvick et al. |
| 2017/0167299 | A1 | 6/2017 | Heard et al. |

FOREIGN PATENT DOCUMENTS

| | | | |
|---|---|---|---|
| EP | 3178771 | A1 | 6/2017 |
| EP | 3179168 | A1 | 6/2017 |
| EP | 2993314 | B1 | 11/2017 |
| WO | WO2017/116242 | A1 | 7/2017 |
| WO | WO2017/116244 | A1 | 7/2017 |

* cited by examiner

*Primary Examiner* — Christopher J Besler
(74) *Attorney, Agent, or Firm* — Dority & Manning, P.A.

(57) ABSTRACT

A lift assembly includes an upper rail. A plurality of rail flanges extend from the upper rail. The lift assembly further includes a plurality of combustion can support assemblies spaced apart from one another. Each combustion can support assembly of the plurality of combustion can support assemblies includes a support flange slidably coupled to a rail flange of the plurality of rail flanges, an outer sleeve, and an inner sleeve assembly configured to removably couple to a combustion can of the turbomachine. Each combustion can support assembly of the plurality of combustion can support assemblies defines a cylindrical coordinate system having an axial direction, a radial direction, and a circumferential direction. Each combustion can support assembly of the plurality of support assemblies is configured to move along any of the axial direction, the radial direction, or the circumferential direction relative to the upper rail.

18 Claims, 10 Drawing Sheets

COMBUSTION CAN LIFT ASSEMBLY

FIELD

The present disclosure relates generally to assemblies and methods for installing and removing combustion cans from a turbomachine. In particular, the present disclosure relates to assemblies and methods for installing and removing combustion cans from the upper half of a turbomachine combustion section.

BACKGROUND

Turbomachines are utilized in a variety of industries and applications for energy transfer purposes. For example, a gas turbine engine generally includes a compressor section, a combustion section, a turbine section, and an exhaust section. The compressor section progressively increases the pressure of a working fluid entering the gas turbine engine and supplies this compressed working fluid to the combustion section. The compressed working fluid and a fuel (e.g., natural gas) mix within the combustion section and burn in a combustion chamber to generate high pressure and high temperature combustion gases. The combustion gases flow from the combustion section into the turbine section where they expand to produce work. For example, expansion of the combustion gases in the turbine section may rotate a rotor shaft connected, e.g., to a generator to produce electricity. The combustion gases then exit the gas turbine via the exhaust section.

More specifically, the combustion section mixes large quantities of fuel and compressed air and burns the resulting mixture. The combustion section of a gas turbines can include an annular array of cylindrical combustion "cans" in which air and fuel are mixed and combustion occurs. Compressed air from an axial compressor flows into the combustor. Fuel is injected through fuel nozzle assemblies mat extend into each can. The mixture of fuel and air bums in a combustion chamber of each can. The combustion gases discharge from each can into a duct that leads to the turbine.

Combustion cans need to be installed during the initial build of the gas turbine and may subsequently be removed during subsequent maintenance activities. However, to install, remove or re-install one or more combustion cans, a significant amount of force may be required to properly lift, position and/or align each combustion can with respect to the gas turbine. Accordingly, alternative assemblies and methods for installing and removing combustion cans would be welcome in the art.

BRIEF DESCRIPTION

Aspects and advantages of the lift assemblies and methods in accordance with the present disclosure will be set forth in part in the following description, or may be obvious from the description, or may be learned through practice of the technology.

In accordance with one embodiment, a lift assembly for installation and removal of one or more combustion cans from a turbomachine is provided. The lift assembly includes an upper rail. A plurality of rail flanges extend from the upper rail. The lift assembly further includes a plurality of combustion can support assemblies spaced apart from one another. Each combustion can support assembly of the plurality of combustion can support assemblies includes a support flange slidably coupled to a rail flange of the plurality of rail flanges, an outer sleeve, and an inner sleeve assembly configured to removably couple to a combustion can of the turbomachine. Each combustion can support assembly of the plurality of combustion can support assemblies defines a cylindrical coordinate system having an axial direction, a radial direction, and a circumferential direction. Each combustion can support assembly of the plurality of support assemblies is configured to move along any of the axial direction, the radial direction, or the circumferential direction relative to the upper rail.

In accordance with another embodiment, a method of using a lift assembly is provided. The lift assembly includes an upper rail, a rail flange extending from the upper rail, and a combustion can support assembly. The combustion can support assembly includes a support flange slidably coupled to the rail flange, an outer sleeve, and an inner sleeve assembly configured to removably couple to a combustion can of the turbomachine. The method includes inserting a combustion can into the inner sleeve assembly of the support assembly when the lift assembly is in a first position on a support surface. The method further includes securing the combustion can to the support assembly by tightening the outer sleeve. The method further includes moving the lift assembly to a second position in which the combustion can is positioned proximate a respective combustor assembly. The method further includes aligning the combustion can with the respective combustor assembly by moving the support assembly relative the upper rail. The method further includes securing the combustion can to the turbomachine.

These and other features, aspects and advantages of the present lift assemblies and methods will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present lift assemblies and methods, including the best mode of making and using the present systems and methods, directed to one of ordinary skill in the art, is set forth in the specification, which makes reference to the appended figures, in which.

DETAILED DESCRIPTION

Figure 1:
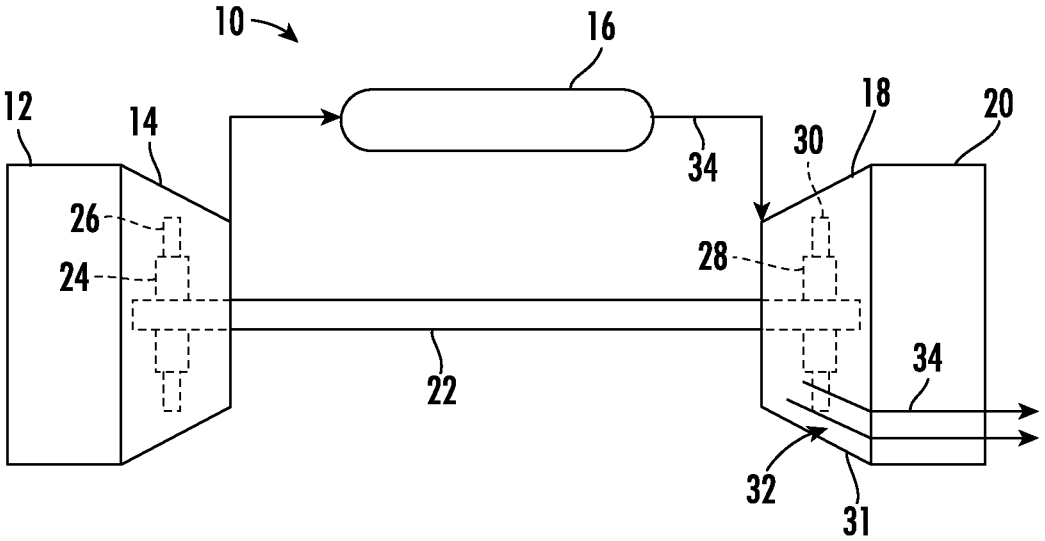
FIG. 1 is a schematic illustration of a turbomachine in accordance with embodiments of the present disclosure.

Reference now will be made in detail to embodiments of the present lift assemblies and methods, one or more examples of which are illustrated in the drawings. Each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components.

The term "fluid" may be a gas or a liquid. The term "fluid communication" means that a fluid is capable of making the connection between the areas specified.

As used herein, the terms "upstream" (or "forward") and "downstream" (or "aft") refer to the relative direction with respect to fluid flow in a fluid pathway. For example, "upstream" refers to the direction from which the fluid flows, and "downstream" refers to the direction to which the fluid flows. However, the terms "upstream" and "downstream" as used herein may also refer to a flow of electricity. The term "radially" refers to the relative direction that is substantially perpendicular to an axial centerline of a particular component, the term "axially" refers to the relative direction that is substantially parallel and/or coaxially aligned to an axial centerline of a particular component and the term "circumferentially" refers to the relative direction that extends around the axial centerline of a particular component.

Terms of approximation, such as "about," "approximately," "generally," and "substantially," are not to be limited to the precise value specified. In at least some instances, the approximating language may correspond to the precision of an instrument for measuring the value, or the precision of the methods or machines for constructing or manufacturing the components and/or systems. In at least some instances, the approximating language may correspond to the precision of an instrument for measuring the value, or the precision of the methods or machines for constructing or manufacturing the components and/or systems. For example, the approximating language may refer to being within a 1, 2, 4, 5, 10, 15, or 20 percent margin in either individual values, range(s) of values and/or endpoints defining range(s) of values. When used in the context of an angle or direction, such terms include within ten degrees greater or less than the stated angle or direction. For example, "generally vertical" includes directions within ten degrees of vertical in any direction, e.g., clockwise or counter-clockwise.

The terms "coupled," "fixed," "attached to," and the like refer to both direct coupling, fixing, or attaching, as well as indirect coupling, fixing, or attaching through one or more intermediate components or features, unless otherwise specified herein. As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

Referring now to the drawings, FIG. 1 illustrates a schematic diagram of one embodiment of a turbomachine, which in the illustrated embodiment is a gas turbine 10. Although an industrial or land-based gas turbine is shown and described herein, the present disclosure is not limited to a land-based and/or industrial gas turbine unless otherwise specified in the claims. For example, the invention as described herein may be used in any type of turbomachine including but not limited to a steam turbine, an aircraft gas turbine, or a marine gas turbine.

As shown, gas turbine 10 generally includes an inlet section 12, a compressor section 14 disposed downstream of the inlet section 12, a plurality of combustors (not shown) within a combustor (or combustion) section 16 disposed downstream of the compressor section 14, a turbine section 18 disposed downstream of the combustor section 16, and an exhaust section 20 disposed downstream of the turbine section 18. Additionally, the gas turbine 10 may include one or more shafts 22 coupled between the compressor section 14 and the turbine section 18.

The compressor section 14 may generally include a plurality of rotor disks 24 (one of which is shown) and a plurality of rotor blades 26 extending radially outwardly from and connected to each rotor disk 24. Each rotor disk 24 in turn may be coupled to or form a portion of the shaft 22 that extends through the compressor section 14.

The turbine section 18 may generally include a plurality of rotor disks 28 (one of which is shown) and a plurality of rotor blades 30 extending radially outwardly from and being interconnected to each rotor disk 28. Each rotor disk 28 in turn may be coupled to or form a portion of the shaft 22 that extends through the turbine section 18. The turbine section 18 further includes an outer casing 31 that circumferentially surrounds the portion of the shaft 22 and the rotor blades 30, thereby at least partially defining a hot gas path 32 through the turbine section 18.

During operation, a working fluid such as air flows through the inlet section 12 and into the compressor section 14 where the air is progressively compressed, thus providing pressurized air to the combustors of the combustor section 16. The pressurized air is mixed with fuel and burned within each combustor to produce combustion gases 34. The combustion gases 34 flow through the hot gas path 32 from the combustor section 16 into the turbine section 18, wherein energy (kinetic and/or thermal) is transferred from the combustion gases 34 to the rotor blades 30, causing the shaft 22 to rotate. The mechanical rotational energy may then be used to power the compressor section 14 and/or to generate electricity. The combustion gases 34 exiting the turbine section 18 may then be exhausted from the gas turbine 10 via the exhaust section 20.

Figure 2:
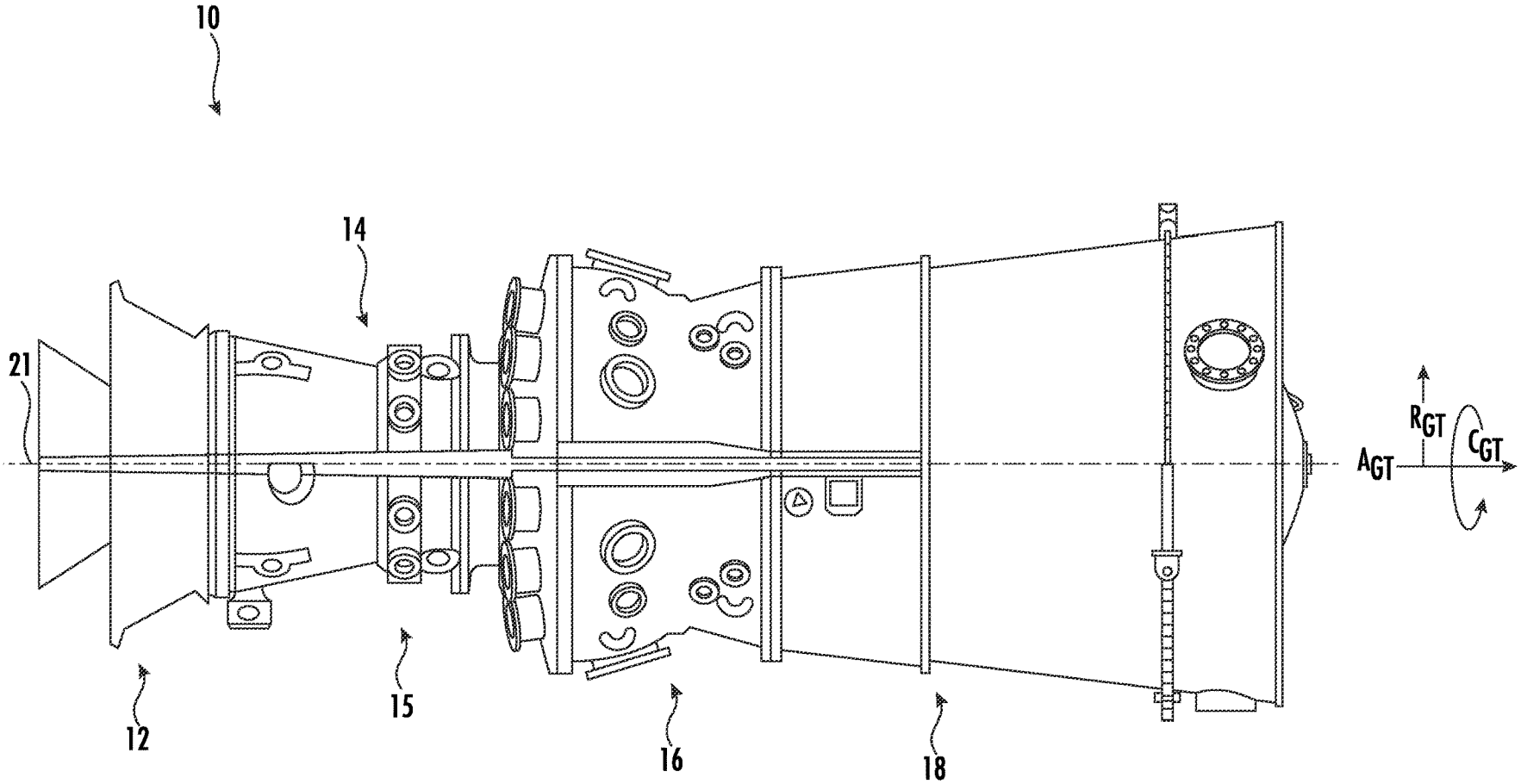
FIG. 2 illustrates a side view of a gas turbine in accordance with embodiments of the present disclosure.

Referring now to FIG. 2, some turbomachines, such as gas turbines, aero-derivatives, or the like, burn a fuel and an air mixture during a combustion process to generate energy. FIG. 2 illustrates an example of a gas turbine 10. As shown, the gas turbine 10 may define a cylindrical coordinate system having an axial direction $A_{gt}$ extending along an axial centerline 21, a radial direction $R_{gt}$ perpendicular to the axial centerline 21, and a circumferential direction $C_{gt}$ extending around the axial centerline 21. The upper rail 202 may extend along the circumferential direction $C_{gt}$ of the gas turbine 10.

Generally, the gas turbine 10 comprises an inlet section 12 that directs an airstream towards a compressor section 14 housed in a compressor casing 15. The airstream is compressed and then discharged to a combustor section 16, where a fuel, such as natural gas, is burned to provide high-energy combustion gases, which drives the turbine section 18. In the turbine section 18, the energy of the hot gases is converted into work, some of which is used to drive the compressor, with the remainder available for useful work to drive a load such as the generator, mechanical drive, or the like (none of which are illustrated).

Figure 3:
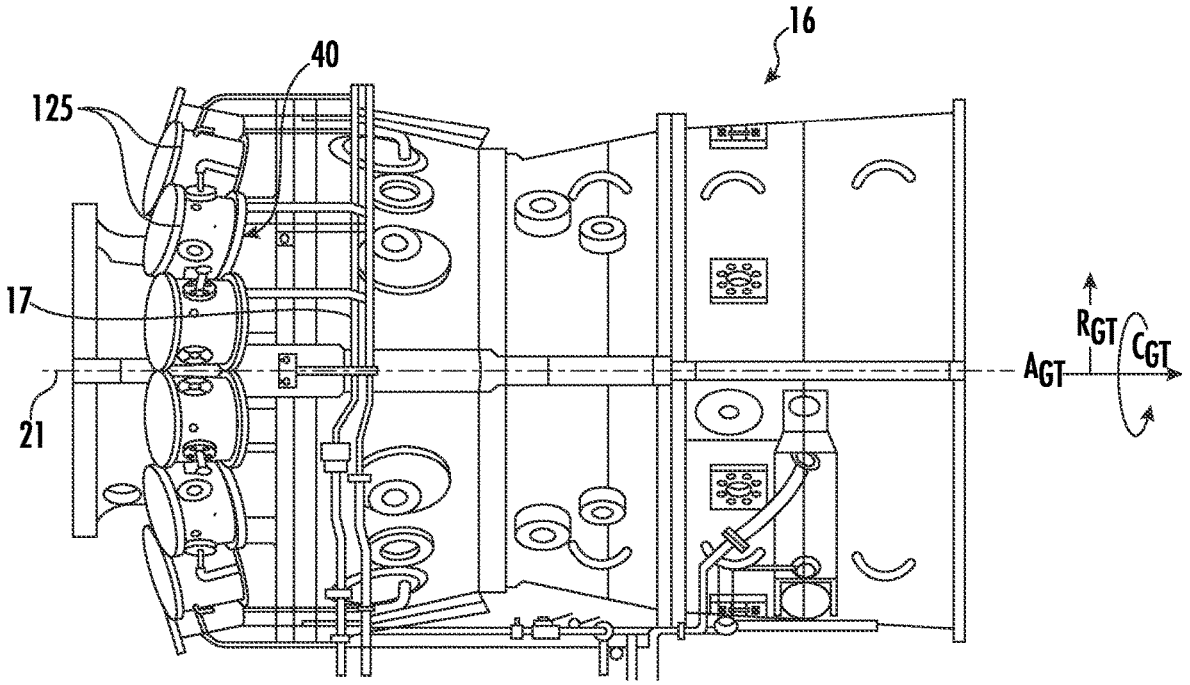
FIG. 3 illustrates a side view of a combustion section of a gas turbine in accordance with embodiments of the present disclosure.

Referring now additionally to FIG. 3, an embodiment of the combustor section 16 may comprise at least one combustor assembly 40. Some gas turbines 10, such as that illustrated in FIG. 3, may comprise a plurality of combustor assemblies 40 disposed in an annular array around the axial centerline 21. Generally, within each combustor assembly 40 (and more specifically, the combustion can 125 of the combustor assembly 40) the aforementioned combustion process occurs. In some embodiments, combustor assemblies 40 can comprise one or more auxiliary systems such as flame detection systems to monitor the flame burning in some of the combustor assemblies 40. Such flame detection systems may be in the form of a flame scanner, a portion of which may be inserted within the combustor assembly 40. Additional or alternative auxiliary systems 17 may similarly be incorporated into combustor assemblies 40 to monitor, control and/or impact one or more of the combustor assembly processes.

Figure 4:
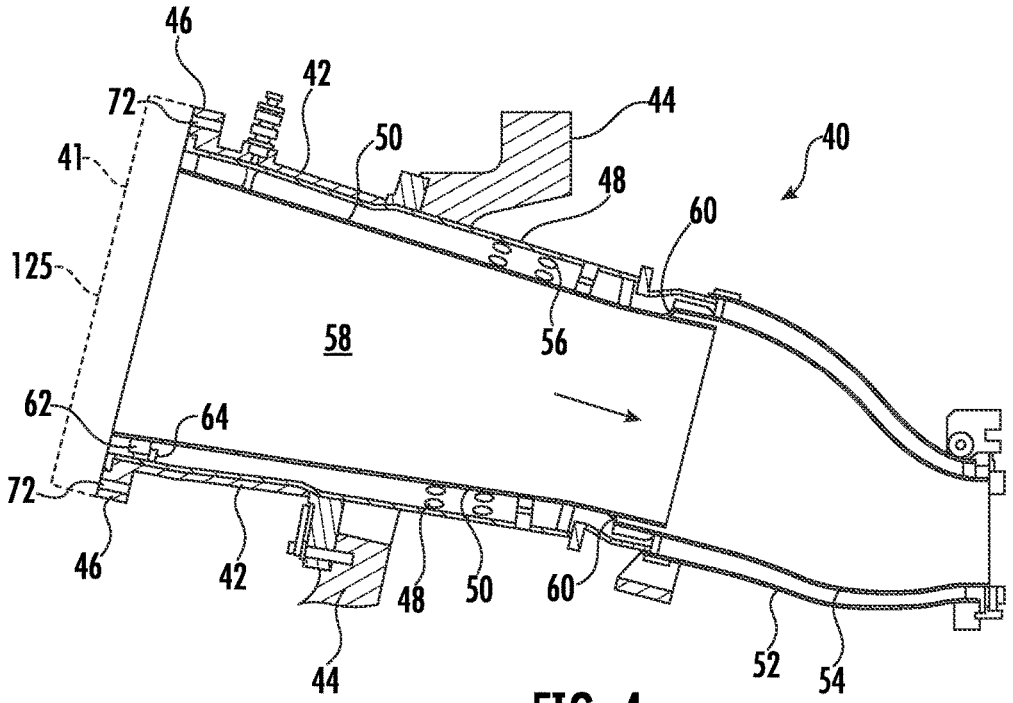
FIG. 4 illustrates a cross-sectional side view of a combustor assembly in accordance with embodiments of the present disclosure.
Figure 5:
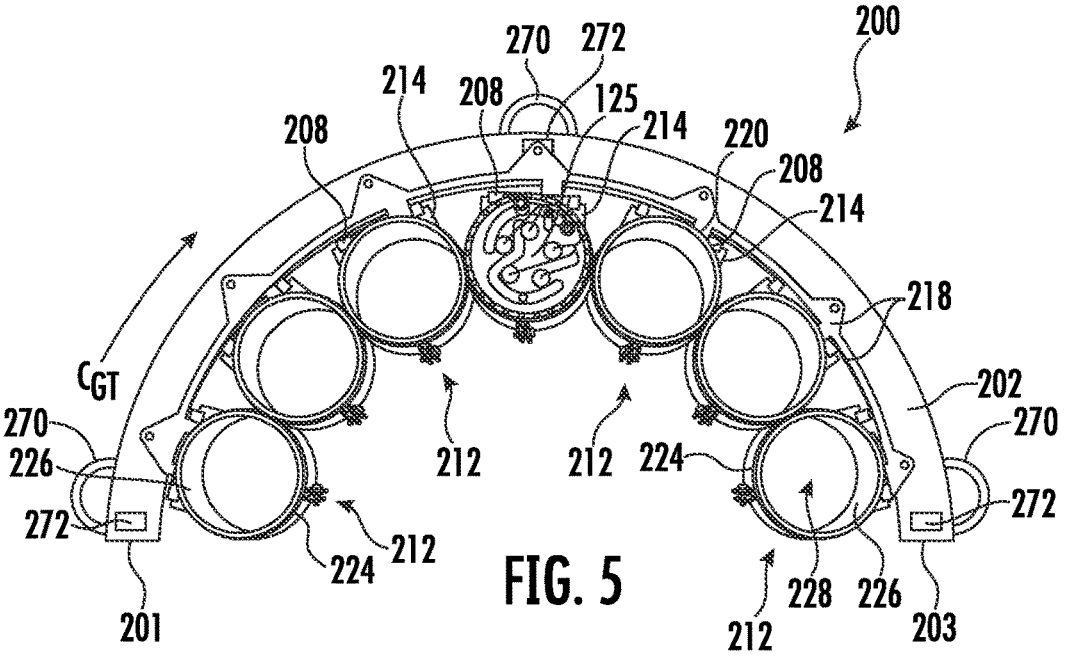
FIG. 5 illustrates a forward view of a lift assembly in accordance with embodiments of the present disclosure.
Figure 6:
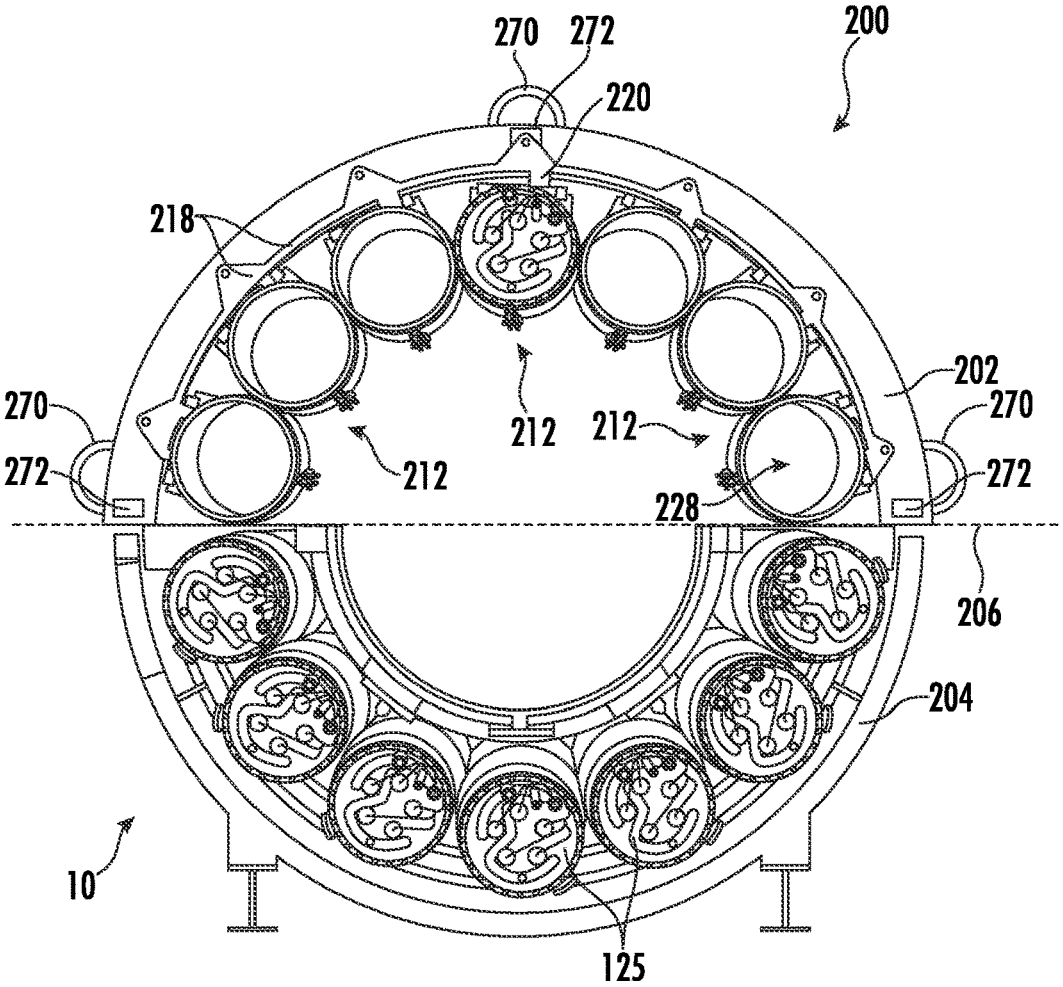
FIG. 6 illustrates a forward view of a lift assembly being utilized in a gas turbine in accordance with embodiments of the present disclosure.
Figure 7:
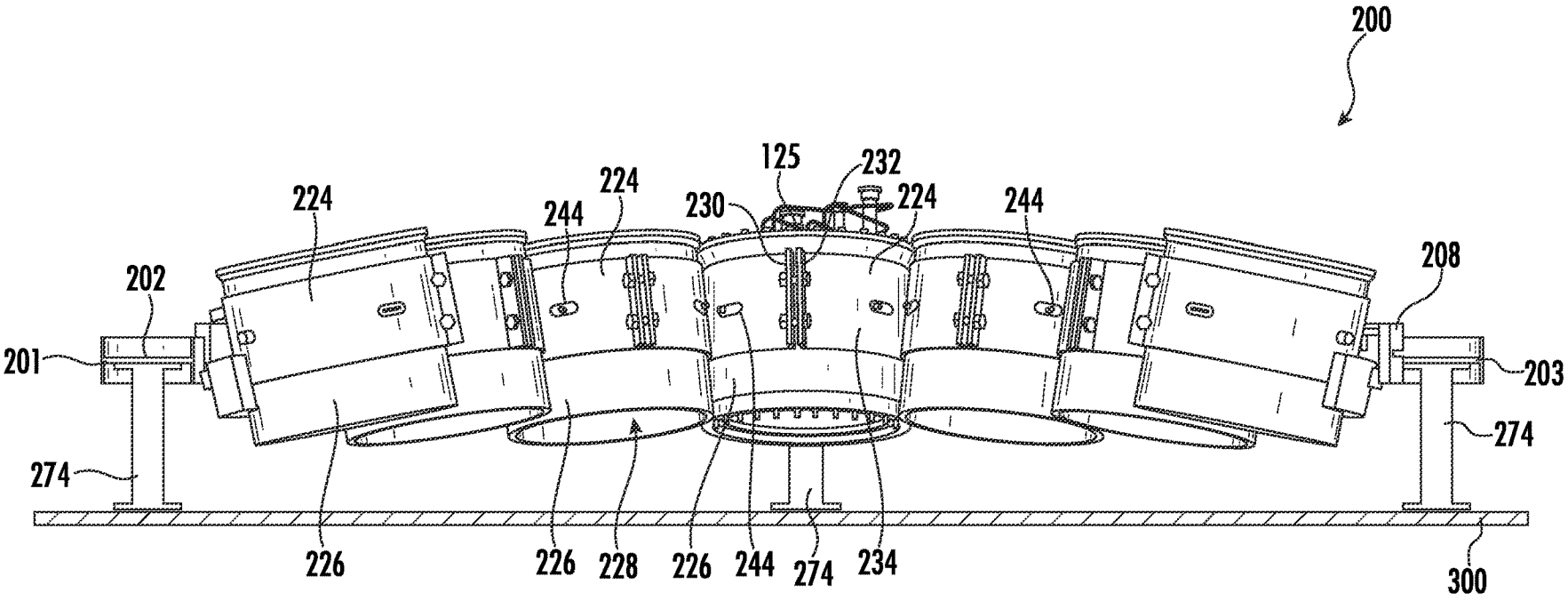
FIG. 7 illustrates a perspective view of a lift assembly in accordance with embodiments of the present disclosure.

Referring additionally to FIG. 4, a cross-sectional side view of an embodiment of a combustor assembly 40 of a gas turbine 10 is illustrated. The combustor assembly 40 may generally include at least a combustion can 125 and potentially a substantially cylindrical combustion casing 42 secured to a portion of a gas turbine casing 44, such as a compressor discharge casing or a combustion wrapper casing. As shown, a flange 46 may extend outwardly from an upstream end of the combustion casing 42. The flange 46 may generally be configured such that an end cover assembly 41 of a combustor assembly 40 may be secured to the combustion casing 42. For example, the flange 46 may define a plurality of flange holes 72 for attaching the end cover assembly 41 to the combustion casing 42.

In some embodiments, the combustor assembly 40 may also include an internal flow sleeve 48 and/or a combustion liner 50 substantially concentrically arranged within the flow sleeve 48. The combustor assembly 40 may comprise a unibody combustor assembly 40 comprising the combustion can 125 and at least one of the flow sleeve 48 or combustion liner 50 connected to the combustion can 125 as a single pre-assembled structure, or the combustor assembly 40 may comprise an assembly where the combustion can 125, flow sleeve 48 and combustion liner 50 all connect directly to the gas turbine 10 such as to the turbine casing 44 (sometimes referred to as a combustion discharge casing or "CDC"). For example, the flow sleeve 48 and the combustion liner 50 may extend, at their downstream ends, to a double walled transition duct, including an impingement sleeve 52 and a transition piece 54 disposed within the impingement sleeve 52. It should be appreciated that in some embodiments the impingement sleeve 52 and the flow sleeve 48 may be provided with a plurality of air supply holes 56 over a portion of their surfaces, thereby permitting pressurized air from the compressor section 14 to enter the radial space between the combustion liner 50 and the flow sleeve 48.

The combustion liner 50 of the combustor assembly 40 may generally define a substantially cylindrical combustion chamber 58, wherein fuel and air are injected and combusted to produce hot gases of combustion. Additionally, the combustion liner 50 may be coupled at its downstream end to the transition piece 54 such that the combustion liner 50 and the transition piece 54 generally define a flow path for the hot gases of combustion flowing from each combustor assembly 40 to the turbine section 18 of the gas turbine 10.

In some embodiments, such as that illustrated in FIG. 4, the transition piece 54 may be coupled to the downstream end of the combustion liner 50 with a seal 60 (e.g., a compression seal). For example, the seal 60 may be disposed at the overlapping ends of the transition piece 54 and combustion liner 50 to seal the interface between the two components. For example, a seal 60 may comprise a circumferential metal seal configured to be spring/compression loaded between inner and outer diameters of mating parts. It should be appreciated, however, that the interface between the combustion liner 50 and the transition piece 54 need not be sealed with a compression seal 60, but may generally be sealed by any suitable seal known in the art.

In some embodiments, the combustion liner 50 may also include one or more male liner stops 62 that engage one or more female liner stops 64 secured to the flow sleeve 48 or, in combustor assemblies 40 without a flow sleeve 48, the combustion casing 42. In particular, the male liner stops 62 may be adapted to slide into the female liner stops 64 as the combustion liner 50 is installed within the combustor assembly 40 to indicate the proper installation depth of the combustion liner 50 as well as to prevent rotation of the liner 50 during operation of the gas turbine 10. Moreover, it should be appreciated that, in some embodiments, male liner stops 62 may be additionally or alternatively disposed on the flow sleeve 48 or combustion casing while the female liner stops 64 are disposed on the combustion liner 50.

In some embodiments, the combustion liner 50 may first be installed within a combustor assembly 40, by being pushed into the combustor assembly 40. For example, the combustion liner 50 can be pushed into the combustor assembly 40 until a force limits further installation depth into the transition piece 54. With continued reference to FIG. 3, a combustion can 125 can then be installed into each respective combustor assembly 40. Specifically, the combustion can 125 can be positioned, aligned and inserted such that its end cover assembly 41 can then abut against the flange 46 of the combustor assembly 40.

While specific embodiments have been presented herein, it should be appreciated that the combustor assembly 40 may comprise a variety of different components that are assembled in a variety of different orders with respect to the individual connections made with the gas turbine 10. For example, the combustor assembly 40 may be completely assembled prior to installation onto the gas turbine 10 (e.g., a unibody combustor assembly 40), may be partly assembled prior to installation on the gas turbine 10, may be completely assembled while connected to the gas turbine 10, or combinations thereof.

FIGS. 5 through 11 illustrate embodiments of a lift assembly 200 in accordance with embodiments of the present disclosure. As will be discussed, the lift assembly 200 may facilitate the installation and/or removal of one or more combustion cans 125 from the combustor assembly 40 of the gas turbine 10. For example, the lift assembly 200 may advantageously be a compact design that allows for one or more combustion cans 125 to be installed, removed, or reinstalled without having to fully disassemble the gas turbine 10. As may be appreciated by those of skill in the art, gas turbines (such as the gas turbine 10) are often crowded with various pipings and external hardware that can make accessing the combustion section (e.g., for installation or removal of one or more combustion cans 125) difficult. The compactness of the lift assembly 200 described herein may advantageously be used to install and/or remove combustion cans 125 into a combustor assembly 40 without having to remove external hardware and/or pipings.

In exemplary implementations, the lift assembly 200 may be placed in a first position in which the lift assembly 200 is rested horizontally on a support surface 300 (such as the ground or floor). In the first position the lift assembly 200 may be loaded with one or more combustion cans 125 before being lifted to a second position in which the combustion cans 125 may be installed into the combustor assembly 40.

As shown in FIGS. 5 through 10 collectively, the lift assembly 200 may include an upper rail 202 having a circumferential curvature with respect to an axial centerline 21 of the turbomachine. As shown, the upper rail 202 may be an I-beam that extends halfway along a circular path (e.g., the upper rail 202 may be semi-circular or extend halfway along the perimeter of a circle). As shown, the upper rail 202 may extend from a first end 201 to a second end 203.

In many embodiments, the upper rail 202 may couple to a lower rail 204, such that the lower rail 204 and the upper rail 202 collectively surround the axial centerline 21 of the gas turbine 10. In many embodiments, the upper rail 202 and the lower rail 204 may collectively surround the gas turbine 10 radially outward from the combustor assembly 40 with respect to the radial direction $R_{gt}$ of the gas turbine 10. For example, the lower rail 204 may extend around the lower half of the gas turbine 10 (e.g., about 180° below a horizontal plane 206 that is parallel to the ground and divides the gas turbine in half), and the upper rail 202 may extend around the upper half of the gas turbine 10 (e.g., about 180° above the horizontal plane 206). In exemplary embodiments, the upper rail 202 and the entire lift assembly 200 may extend about an upper half of the gas turbine 10 (e.g., above the horizontal plane 206), such that lift assembly 200 is used for removing and/or installing one or more combustion cans 125 in the upper half of the gas turbine 10 combustion section 16 (e.g., above the horizontal plane 206).

In many embodiments, the lift assembly 200 may further include a plurality of rail flanges 208 extending from the upper rail 202. For example, each of the rail flanges 208 may extend inwardly from the upper rail 202 (e.g., radially inwardly with respect to the axial centerline 21 of the gas turbine 10). In some embodiments, the rail flanges 208 may each be fixedly coupled to the upper rail 202, such as via welding or brazing, and such that the rail flanges 208 do not move relative to the upper rail 202. As shown, the each of the rail flanges may define a first connection surface 210.

In exemplary embodiments, the lift assembly 200 may further include a plurality of combustion can support assemblies 212, with each combustion can support assembly 212 being configured to removably couple to a respective combustion can 125. The combustion can support assemblies 212 may be spaced apart from each other (e.g., circumferentially spaced apart with respect to the circumferential direction $C_{gt}$ of the gas turbine 10). For example, the circumferential spacing of the combustion can support assemblies 212 may advantageously correspond with the circumferential spacing of the combustors in the combustor assembly 40. In this way, when the lift assembly 200 rested on the lower rail 204 (e.g., in the loading position shown in FIG. 6), the combustion cans 125 within the combustion can support assemblies 212 are each circumferentially aligned with a respective combustor assembly 40.

Additionally, the number of combustion can support assemblies 212 coupled to the lift assembly 200 may correspond with the number of combustor assemblies 40 in the upper half of the gas turbine (e.g., above the horizontal plane 206). For example, in the illustrated embodiments shown in FIGS. 5 through 10, the lift assembly 200 may include seven support assemblies 212, such that the lift assembly 200 is capable of lifting seven combustor cans 125 simultaneously. It should be appreciated and understood that other embodiments of the lift assembly 200 that include greater than or less than seven combustion can support assemblies (such as 1, 2, 3, 4, 5, 6, 7, 8, 9, or greater than 10) are within the scope of the present disclosure, and the lift assembly 200 should not be limited to seven combustion can support assemblies 212 unless specifically recited in the claims.

As shown in FIGS. 5 through 10 collectively, each combustion can support assembly 212 of the plurality of combustion can support assemblies 212 defines a cylindrical coordinate system 205 having an axial direction $A_{SA}$, a radial direction $R_{SA}$, and a circumferential direction $C_{SA}$. Each combustion can support assembly 212 of the plurality of support assemblies 212 is configured to move the along any of the axial direction $A_{SA}$, the radial direction $R_{SA}$, and/or the circumferential direction $C_{SA}$ relative to the upper rail 202 to adjust a position of the combustion can 125 contained therein. For example, in exemplary implementations, once the lift assembly 200 is rested on the lower rail 204 and in a loading position (such as the position shown in FIG. 6), each support assembly 212 may be moved in any direction along the cylindrical coordinate system 205 to align each combustion can 125 with a respective combustor assembly 40. Once aligned, the combustion cans 125 may be coupled to the respective combustor assemblies and the lift assembly may be removed to resume operation of the gas turbine 10.

In exemplary embodiments, each combustion can support assembly 212 of the plurality of combustion can support assemblies 212 includes a support flange 214 slidably coupled to a rail flange 208 of the plurality of rail flanges 208. For example, each support flange 214 may define a second connection surface 216 that is complementary and corresponds with the first connection surface 210 of the rail flange 208 to which it is attached. In exemplary embodiments, both the first connection surface 210 of the rail flange 208 and the second connection surface 216 of the support flange 214 may be contoured surfaces that interconnect with one another but allow for sliding movement relative to one another. The support flange 214 and the rail flange 208 may be slidable relative to one another to adjust a position of the combustion can support assembly 212 (thereby adjusting the position of the combustion can 125 contained therein). For example, in exemplary implementations, the support flange 214 and the rail flange 208 may be slidable relative to one another to adjust an axial position of the combustion can support assembly 212 (e.g., along the axial direction $A_{SA}$ of the combustion can support assembly 212).

In many embodiments, the lift assembly 200 may further include a rail extension 218 coupled to the upper rail 202. The rail extension may be contoured to correspond with the upper rail 202. For example, the rail extension 218 may extend along the circumferential direction $C_{gt}$ of the gas turbine 10 when the lift assembly is in a loading position (such as the position shown in FIG. 6). In some embodiments, the rail extension 218 may be fixedly coupled to the upper rail 202, such as by welding or brazing, and such that the rail extension 218 does not move relative to the upper rail 202. In other embodiments (not shown), the rail extension 218 and the upper rail 202 may be integral, such that they are a unitary and/or singular component.

In various embodiments, the lift assembly 200 may include a tab 220 extending radially inward from the upper rail 202 with respect to the axial centerline 21 of the turbomachine (such as the gas turbine 10). In exemplary embodiments, the tab 220 may be defined by the rail extension 218. However, in other embodiments, the tab 220 may be defined by the upper rail 202. A first jacking bolt 222 may extend through the tab 220 and into the support flange 214 such that rotation of the jacking bolt 222 moves the support assembly 212 along the axial direction $A_{SA}$. For example, the jacking bolt 222 may be a threaded fastener or threaded bolt having a threaded exterior surface. Likewise, both the tab 220 and the support flange 214 may have threaded interior surfaces, such that rotation of the jacking bolt 222 causes the support flange 214 and the rail flange 208 to slide relative to one another to adjust a position of the support assembly 212 (e.g., in the axial direction $A_{SA}$ of the combustion can support assembly).

In exemplary embodiments, each support assembly 212 may include an outer sleeve 224 and an inner sleeve assembly 226. As shown, both the outer sleeve 224 and the inner sleeve assembly 226 may be generally shaped as hollow cylinders having open ends, thereby corresponding with and being complementary to an exterior shape of the combustion can 125 in order to couple thereto. For example, as shown, the inner sleeve assembly 226 may removably couple to a combustion can 125. The outer sleeve 224 may surround (e.g., annularly surround), and contact, an exterior surface of the inner sleeve assembly 226. In many embodiments, an inner surface of the inner sleeve assembly 226 may define an interior 228, into which a combustion can 125 may be inserted. In many embodiments, the outer sleeve 224 and the inner sleeve 226 may be concentric with one another, such that they share a common axial centerline.

In particular embodiments, the outer sleeve 224 may fixedly coupled to the support flange 214 (such as via a braze joint or weld joint), such that the outer sleeve 224 is movable with the support flange 214. In many embodiments, the outer sleeve 224 may include a first wall 230, a second wall 232, and a cylindrical portion 234 extending between the first wall 230 and the second wall 232. In such embodiments, the cylindrical portion 234 may be fixedly coupled to the support flange 214, and the first wall 230 and the second wall 232 may be disposed opposite the support flange 214. In particular, the first wall 230 and the second wall 232 may be generally flat, planar, walls that are parallel to one another. The cylindrical portion 234 may extend from the first wall 230, around the inner sleeve assembly 226, to the second wall 232. In many embodiments, an exterior surface of the inner sleeve assembly 226 may be in contact with an interior surface of the cylindrical portion 234 of the outer sleeve 224.

In certain embodiments, the first wall 230 and the second wall 232 may be spaced apart such that a gap 231 is defined therebetween. Additionally, a threaded bolt 240 and nut 242 may couple the first wall 230 to the second wall 232. For example, the threaded bolt 240 may extend through the first wall 230, across the gap 231, through the second wall 232, and couple to a nut 242 (such as a threaded nut), such that rotation of the threaded bolt 240 and/or the nut 242 adjusts the length of the gap 231. That is, rotation of the bolt 240 and/or the nut 242 may directly change the size of the interior 228. For example, the threaded bolt 240 and nut 242 may be loosened to allow the combustion can 125 to be inserted into the interior 228, and subsequently, the threaded bolt 240 and nut 242 may be tightened to secure the combustion can support assembly 212 to the combustion can 125.

Figure 9:
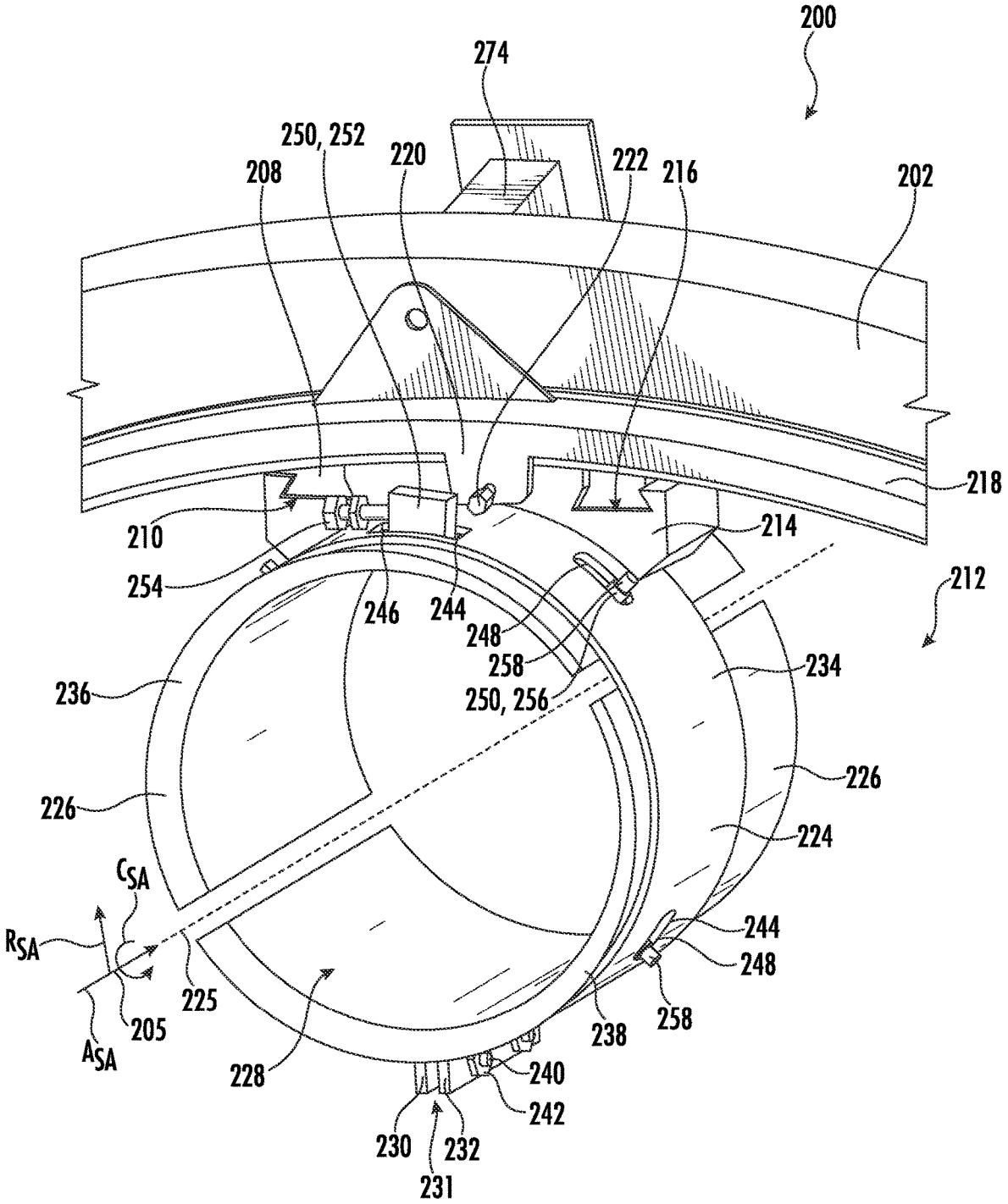
FIG. 9 illustrates an enlarged perspective view of a lift assembly in accordance with embodiments of the present disclosure.
Figure 10:
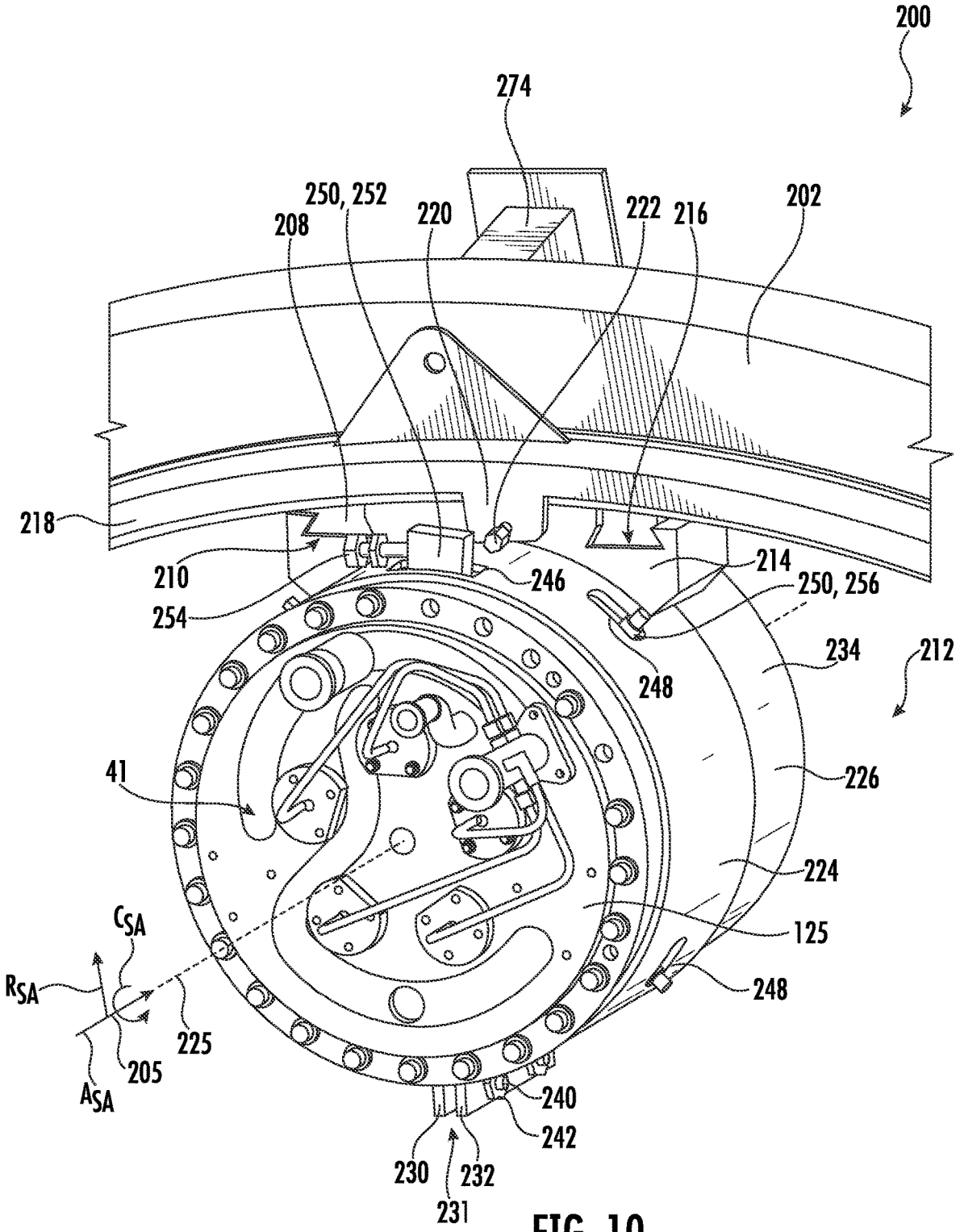
FIG. 10 illustrates an enlarged perspective view of a lift assembly in accordance with embodiments of the present disclosure.
Figure 11A:
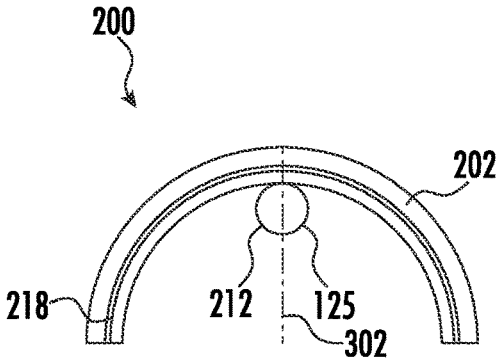
FIGS. 11A through 11G each illustrates a lift assembly carrying one or more combustion cans in accordance with embodiments of the present disclosure.
Figure 11B:
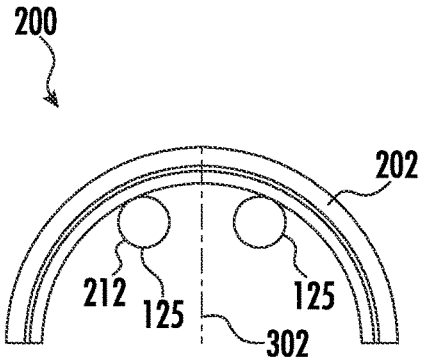
Figure 11C:
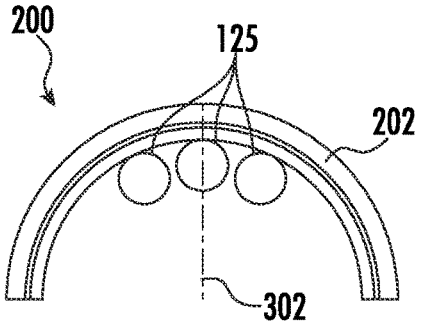
Figure 11D:
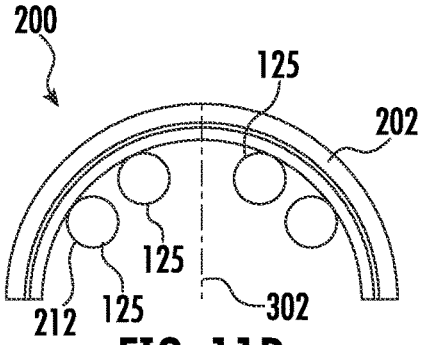
Figure 11E:
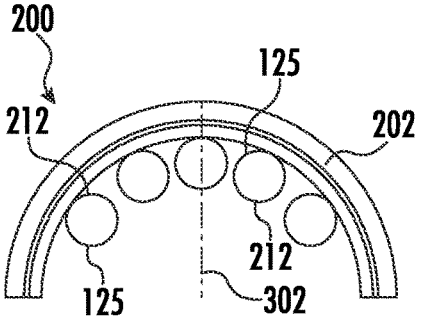
Figure 11F:
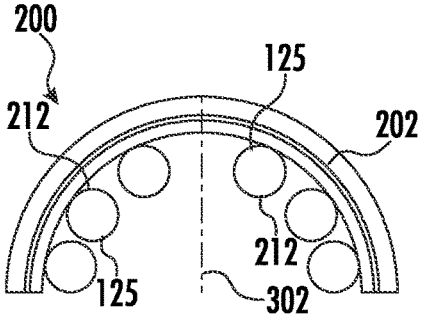
Figure 11G:
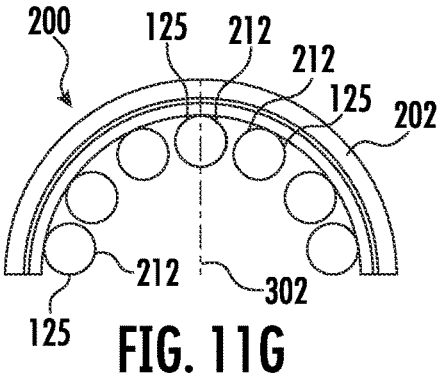

In many embodiments, the inner sleeve assembly 226 may include a first half cylinder 236 and a second half cylinder 238 movable relative to one another (FIG. 9). For example, both the first half cylinder 236 and the second half cylinder 238 may be in sliding contact with the outer sleeve 224. The first half cylinder 236 and the second half cylinder 238 may be sized and contoured to receive a combustion can 125 and removably couple thereto.

In exemplary embodiments, the outer sleeve 224 may define one or more slots 244. In many embodiments, the one or more slots 244 may be defined by the cylindrical portion 234 of the outer sleeve 224. Additionally, each of the one or more slots 244 may be disposed forward of the support flange 214 with respect to the axial direction $A_{gt}$ of the gas turbine 10, such that they may be easily accessed when installing the combustion can 125. For example, the one or more slots 244 may include a rotation slot 246 defined in the cylindrical portion 234. Additionally or alternatively, the one or more slots 244 may include a plurality of compression slots 248 defined in the cylindrical portion 234 of the outer sleeve 224.

Additionally, in particular embodiments, the inner sleeve assembly 226 (such as one or both of the first half cylinder 236 and/or the second half cylinder 238) may include one or more threaded protrusions 250 each extending through a respective slot of the one or more slots 244. For example, the one or more threaded protrusions 250 may include a rotation protrusion 252 extending through the rotation slot 246 defined in the outer sleeve 224. Particularly, the rotation protrusion 252 may extend radially outwardly through the rotation slot 246 with respect to an axial centerline 225 of the support assembly 212. In many embodiments, the rotation protrusion 252 may extend radially through the rotation slot 246 and threadably couple to a second jacking bolt 254. That is, the rotation protrusion 252 may threadably engage the second jacking bolt 254, such that rotation of the second jacking 254 bolt moves the inner sleeve 226 along the circumferential direction $C_{SA}$ (or about the axial direction $A_{SA}$) relative to the outer sleeve 224 and relative to the upper rail 202. When the combustion can support assembly 212 is coupled to a combustion can 125, the rotation protrusion 252 and corresponding second jacking bolt 254 may be used for adjusting the circumferential position of the combustion can 125 being installed.

In certain embodiments, the one or more threaded protrusions 250 may include a compression protrusion 256 (such as multiple compression protrusions in some embodiments). The compression protrusion 256 may extend radially through a respective compression slot 248 of the plurality of compression slots 248. In many embodiments, the compression protrusion 256 may threadably engage a compression bolt 258. For example, the compression bolt 258 may be oriented radially such that rotation of the compression bolt 258 radially moves the inner sleeve assembly 226.

Additionally, as shown, the one or more slots 244 (such as the rotation slot 246 and/or the compression slots 248) and the one or more protrusions 250 extending therethrough (such as the rotation protrusion 252 and/or the compression protrusion 256) may be sized to only allow for movement of the inner sleeve assembly 226 in the radial direction $R_{SA}$ and circumferential direction $C_{SA}$ (movement in the Axial direction $A_{SA}$ may be restricted). For example, the one or more slots 244 and the one or more protrusions 250 may define an axial width that is generally equal (within a plus or minus 5% margin), such that axial movement of a protrusion 250 within the respective slot 244 is restricted. If axial movement of the support assembly 212 is desired, the jacking bolt 222 may be rotated.

Figure 8:
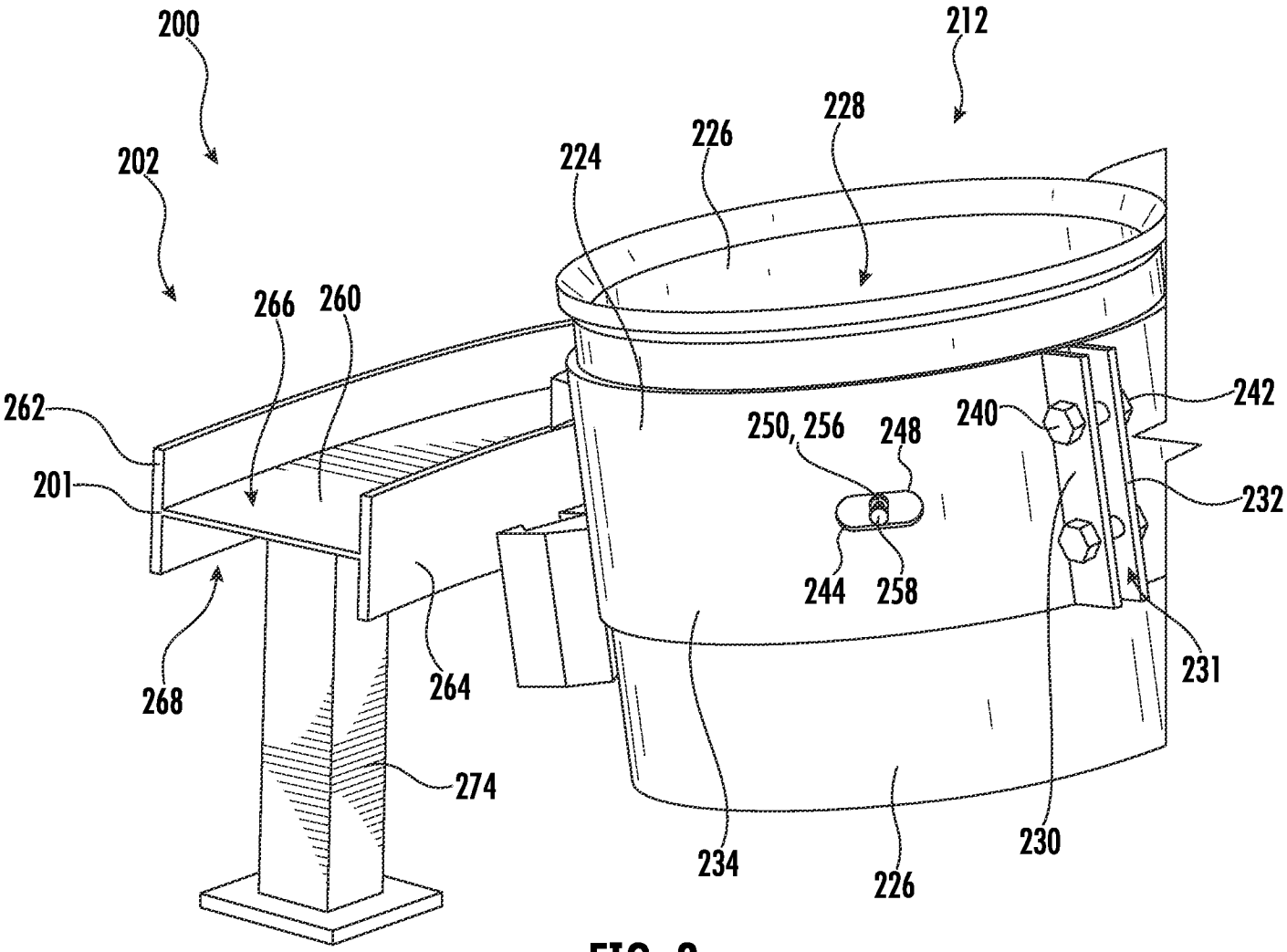
FIG. 8 illustrates an enlarged perspective view of a lift assembly in accordance with embodiments of the present disclosure.

In various embodiments, the upper rail 202 may be an I-beam having a web 260, a first flange 262, and a second flange 264 (FIG. 8). The I-beam construction of the upper rail 202 may advantageously increase the structural integrity of the entire lift assembly 200. The first flange 262 and the second flange 264 may be spaced apart from one another, and the web 260 may extend between the first flange 262 and the second flange 264. The web may include a first side 266 and a second side 268 each extending between the first flange 262 and the second flange 264. In many embodiments, the upper rail 202 may include lifting lugs 270 that are radially oriented. For example, the lifting lugs 270 may extend radially outward from the upper rail 202 (e.g., from the first flange 262). Additionally, the upper rail 202 may further include lifting lugs 272 that are axially oriented. For example, the lifting lugs 272 may be perpendicular to the lifting lugs 270 and may extend axially from the upper rail 202 (e.g., from the first side 266 of the web 260 of the upper rail 202). The lifting lugs 270 and 272 may be generally U-shaped members that allow the lift assembly 200 to be lifted (e.g., by a crane). For example, as discussed above, the upper rail 202 may extend along the perimeter of a semi-circle, and the lifting lugs 270, 272 may be disposed on the upper rail 202 to equally distribute the weight of the lift assembly during movement thereof. For example, one of the lifting lugs 270, 272 may be disposed halfway along the arc of the semi-circular upper rail 202. Additionally, one or more lifting lugs 270, 272 may be disposed on either side (equally spaced to distribute weight) of the center lifting lug. Lifting lugs 270 may be perpendicular to lifting lugs 272, to crate the rotation of upper rail 202 from horizontal position to vertical position during lifting starting from floor resting initial position. For example, a first lifting lug 270 may be disposed at the first end 201 of the upper rail 202, a second lifting lug 270 may be disposed at the second end 203 of the upper rail 202, and a third lifting lug 270 may be disposed between the first end 201 and the second end 203 of the upper rail 202.

Additionally, the upper rail 202 may include legs 274 extending from the second side 268 of the web 260. For example, in the embodiment shown in FIGS. 5 through 10, the lift assembly 200 may include three legs 274. For example, a first leg 274 may be disposed at the first end 201 of the upper rail 202, a second leg 274 may be disposed at the second end 203 of the upper rail 202, and a third leg 274 may be disposed between the first end 201 and the second end 203 of the upper rail 202. As shown, the legs 274 may extend between the second side 268 of the web 260 to the support surface 300 (such as the ground or floor) when the lift assembly 200 is in a horizontal position.

Referring now to FIGS. 11A through 11G, each of which illustrate lift assembly 200 carrying one or more combustion cans 125. As shown, in various implementations of the exemplary lift assembly 200, one or more combustion cans 125 may arranged within the lift assembly 200 to uniformly distribute the weight and keep the lift assembly 200 upright when in use. For example, each of the circles illustrated in FIGS. 11A through 11G may represent a combustion can 125 removably coupled to a respective combustion can support assembly 212. As shown, the lift assembly 200 may define a vertical lifting axis 302 along which an upward lifting force may be applied to move the lift assembly 200. In such embodiments, the one or more combustion cans 125 may be arranged equally on either side of the vertical lifting axis 302, in order to keep the lift assembly 200 in an upright position when it is being moved. Additionally or alternatively, when lifting and/or moving the lift assembly 200 along the vertical lifting axis 302, one or more counterweights may be utilized to equalize the distribution of weight within the lift assembly 200.

Figure 12:
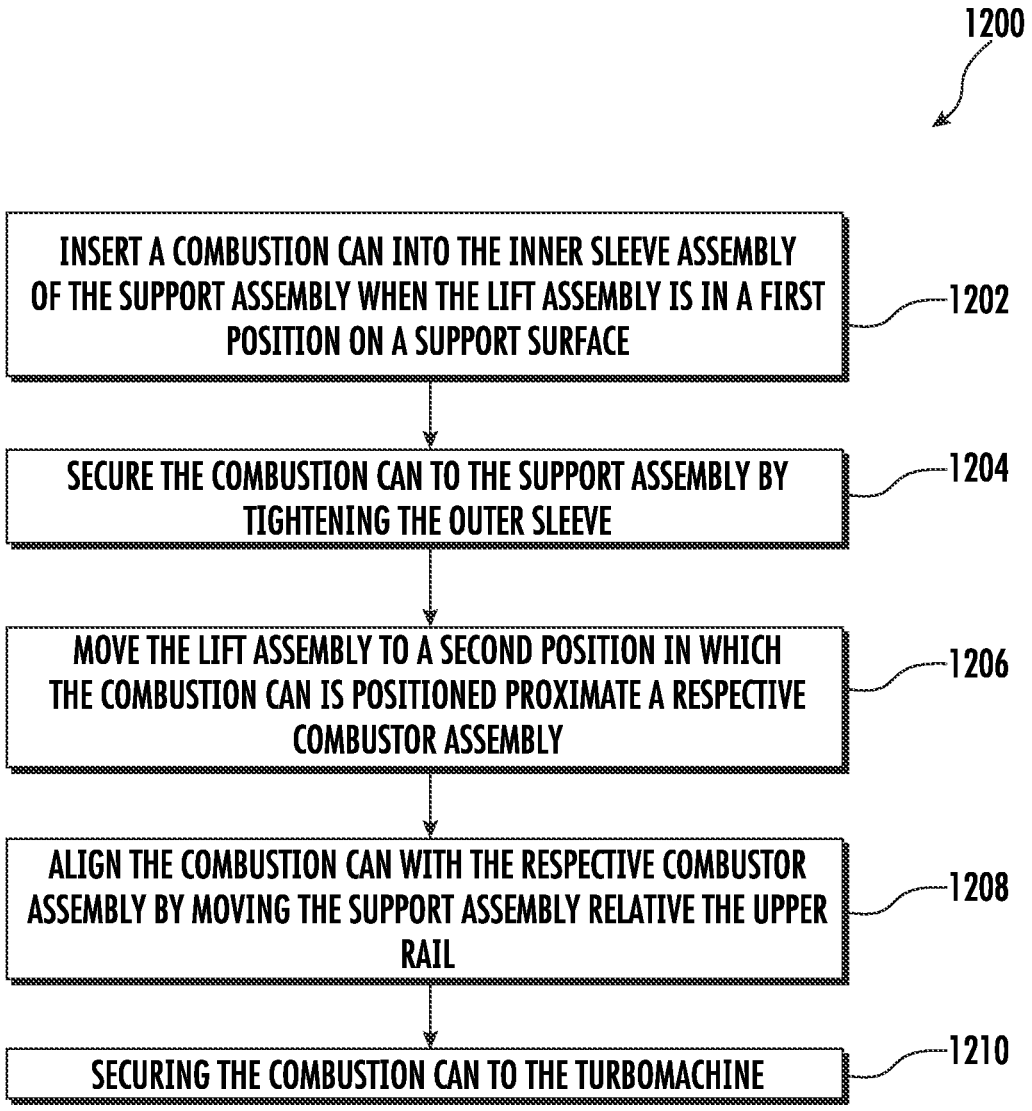
FIG. 12 illustrates a flow chart of a method of using a lift assembly in accordance with embodiments of the present disclosure.

Referring now to FIG. 12, a flow diagram of one embodiment of a method 1200 of using a lift assembly is illustrated in accordance with aspects of the present subject matter. In general, the method 1200 will be described herein with reference to the lift assembly 200 and the gas turbine 10 described above with reference to FIGS. 1-11. However, it will be appreciated by those of ordinary skill in the art that the disclosed method 1200 may generally be utilized with any suitable turbomachine and/or may be utilized in connection with a system having any other suitable system configuration. In addition, although FIG. 12 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As described in more detail above, the lift assembly according to the method 1200 may include an upper rail 202 having a circumferential curvature with respect to an axial centerline of the turbomachine. Additionally, a rail flange 208 may extends from the upper rail 202 and couple to a combustion can support assembly 212. the combustion can support assembly 212 may include a support flange 214 slidably coupled to the rail flange 208, an outer sleeve 224, and an inner sleeve assembly 226 configured to removably couple to a combustion can 125.

As shown, the method 1200 may include a step 1202 of inserting a combustion can 125 into the inner sleeve assembly 226 of the support assembly 212 when the lift assembly 200 is in a first position on a support surface 300 (such as the ground or floor). For example, the first position may be when the lift assembly 200 is resting horizontally on the support surface 300 (such as the position shown in FIG. 7). In such a position the legs 274 may space the upper rail 202 and the support assemblies 212 from the support surface 300, which allows a combustion can 125 to be inserted into the support assembly 212.

In many embodiments, the method 1200 may further include a step 1204 of securing the combustion can 125 to the support assembly 212 by tightening the outer sleeve 224. For example, in some implementations, tightening the outer sleeve 224 may include the rotating the threaded bolt 240 and nut 242 to shorten the gap 231, which moves the inner sleeve assembly 226 and to secures the combustion can support assembly 212 to the combustion can 125. Additionally, one or more of the compression bolts 258 may rotated to radially move the inner sleeve assembly 226 (e.g., to increase the holding force between the inner sleeve assembly 226 and the combustion can 125).

In exemplary implementations, the method 1200 may further include a step 1206 of moving the lift assembly 200 to a second position in which the combustion can 125 is positioned proximate a respective combustor assembly 40. For example, the lift assembly 200 may be lifted with a crane or other lifting means and rested on the lower rail 204 (such as the position shown in FIG. 6). In such a position, the combustion can 125 within the support assembly 212 may be nearly aligned with the combustor assembly 40 to which it will be coupled to. For example, once the lift assembly 200 is in the second position (e.g., vertically oriented and disposed on the lower rail 204), the combustion can 125 within the support assembly may be within a 20% margin of alignment with the respective combustor assembly 40 to which it will be coupled (such as a 15% margin in some embodiments, such as a 10% margin in some embodiments, and/or such as a 5% margin in some embodiments).

In many implementations, the method 1200 may further include a step 1208 of aligning the combustion can 125 with the respective combustor assembly 40 by moving the support assembly 212 relative the upper rail 202. For example, as discussed above, this may be done by rotating one or more of the bolts (such as the first jacking bolt 222, the second jacking bolt 254, and/or the compression bolts 258) to adjust a position of the combustion can 125. For example, the one or more compression bolts 258 may be rotated to adjust a radial position of the combustion can 125 with respect to an axial centerline 225 of the support assembly 212. Additionally or alternatively, the second jacking bolt 254 may be rotated to adjust a circumferential position of the combustion can 125 with respect to an axial centerline 225 of the support assembly 212. Lastly, the method 1200 may include a step 1210 of securing the combustion can 125 to the turbomachine (e.g., the gas turbine). For example, the combustion can 125 may be secured to the respective combustor assembly 40 via one or more bolts, welds, or other means of coupling the combustion can to the combustor assembly 40.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

Further aspects of the invention are provided by the subject matter of the following clauses:

A lift assembly for installation or removal of one or more combustion cans from a turbomachine, the lift assembly comprising an upper rail; a plurality of rail flanges extending from the upper rail; and a plurality of combustion can support assemblies spaced apart from one another, each combustion can support assembly of the plurality of combustion can support assemblies including a support flange slidably coupled to a rail flange of the plurality of rail flanges, an outer sleeve, and an inner sleeve assembly configured to removably couple to a combustion can of the turbomachine, wherein each combustion can support assembly of the plurality of combustion can support assemblies defines a cylindrical coordinate system having an axial direction, a radial direction, and a circumferential direction, and wherein each combustion can support assembly of the plurality of support assemblies is configured to move along any of the axial direction, the radial direction, or the circumferential direction relative to the upper rail.

The lift assembly of one or more of these clauses, further comprising a tab extending radially inward from the upper rail with respect to the axial centerline of the turbomachine, and wherein a first jacking bolt extends through the tab and into the support flange such that rotation of the jacking bolt moves the support assembly in the axial direction.

The lift assembly of one or more of these clauses, further comprising a rail extension coupled to the upper rail, wherein the tab is defined by the rail extension.

The lift assembly of one or more of these clauses, wherein the outer sleeve surrounds the inner sleeve assembly and is fixedly coupled to the support flange such that the outer sleeve is movable with the support flange.

The lift assembly of one or more of these clauses, wherein the outer sleeve defines one or more slots, and wherein inner sleeve includes one or more threaded protrusions each extending through a respective slot of the one or more slots.

The lift assembly of one or more of these clauses, wherein the one or more threaded protrusions include a compression protrusion, the compression protrusion configured to threadably engage a compression bolt, the compression bolt being oriented radially such that rotation of the compression bolt radially moves the inner sleeve assembly.

The lift assembly of one or more of these clauses, wherein the one or more threaded protrusions include a rotation protrusion, the rotation protrusion configured to threadably engage a second jacking bolt such that rotation of the second jacking bolt moves the inner sleeve in the circumferential direction.

The lift assembly of one or more of these clauses, wherein the inner sleeve assembly comprises a half cylinder and a second half cylinder movable relative to one another.

The lift assembly of one or more of these clauses, wherein the outer sleeve comprises a first wall, a second wall, and a cylindrical portion extending between the first wall and the second wall.

The lift assembly of one or more of these clauses, wherein the first wall and the second wall are spaced apart such that a gap is defined therebetween, and wherein a threaded bolt and nut couple the first wall to the second wall.

The lift assembly of one or more of these clauses, wherein the upper rail is an I-beam having a web, a first flange, and a second flange.

The lift assembly of one or more of these clauses, further comprising one or more lifting lugs extending from a first side of the web of the upper rail.

The lift assembly of one or more of these clauses, wherein the upper rail includes legs extending from a second side of the web.

A method of using a lift assembly, the lift assembly comprising an upper rail, a rail flange extending from the upper rail, and a combustion can support assembly, the combustion can support assembly comprising a support flange slidably coupled to the rail flange, an outer sleeve, and an inner sleeve assembly configured to removably couple to a combustion can of the turbomachine the method comprising inserting a combustion can into the inner sleeve assembly of the support assembly when the lift assembly is in a first position on a support surface; securing the combustion can to the support assembly by tightening the outer sleeve; moving the lift assembly to a second position in which the combustion can is positioned proximate a respective combustor assembly; aligning the combustion can with the respective combustor assembly by moving the support assembly relative the upper rail; and securing the combustion can to the turbomachine.

The method of one or more of these clauses, wherein the outer sleeve comprises a first wall, a second wall spaced apart from the first wall such that a gap is defined therebetween, and a cylindrical portion extending between the first wall and the second wall, wherein a threaded bolt and nut couple the first wall to the second wall, and wherein securing the combustion can to the support assembly by tightening the outer sleeve further comprises: rotating the threaded bolt and nut to shorten the gap between the first wall and the second wall.

The method of one or more of these clauses, wherein the outer sleeve defines one or more slots, and wherein inner sleeve defines one or more threaded protrusions each extending through a respective slot of the one or more slots.

The method of one or more of these clauses, wherein the one or more threaded protrusions include a compression protrusion, the compression protrusion configured to threadably engage a compression bolt, the compression bolt being oriented radially with respect to an axial centerline of the combustion can support assembly, and wherein aligning the combustion can further comprises rotating the compression bolt to adjust a radial position of the combustion can.

The method of one or more of these clauses, wherein the one or more threaded protrusions include a rotation protrusion, the rotation protrusion configured to threadably engage a second jacking bolt, and wherein aligning the combustion can further comprises rotating the second jacking bolt to adjust a circumferential position of the combustion can with respect to an axial centerline of the combustion can support assembly.

What is claimed is:

1. A lift assembly for installation or removal of one or more combustion cans from a turbomachine, the lift assembly comprising:

an upper rail;

a plurality of rail flanges extending from the upper rail; and a plurality of combustion can support assemblies spaced apart from one another, each combustion can support assembly of the plurality of combustion can support assemblies including a support flange slidably coupled to a rail flange of the plurality of rail flanges, an outer sleeve, and an inner sleeve assembly configured to removably couple to a combustion can of the turbomachine, wherein each combustion can support assembly of the plurality of combustion can support assemblies defines a cylindrical coordinate system having an axial direction, a radial direction, and a circumferential direction, and wherein each combustion can support assembly of the plurality of support assemblies is configured to move along each of the axial direction, the radial direction, or the circumferential direction relative to the upper rail.

2. The lift assembly of claim 1, further comprising a tab, and wherein a first jacking bolt extends through the tab and into a first support flange of a first combustion can support assembly of the plurality of combustion can support assemblies such that rotation of the first jacking bolt moves the first combustion can support assembly of the plurality of combustion can support assemblies in the axial direction.

3. The lift assembly of claim 2, further comprising a rail extension coupled to the upper rail, wherein the tab is defined by the rail extension.

4. The lift assembly of claim 1, wherein the outer sleeve of a first combustion can support assembly of the plurality of combustion can support assemblies surrounds the inner sleeve assembly of the first combustion can support assembly and is fixedly coupled to the support flange of the first combustion can support assembly such that the outer sleeve of the first combustion can support assembly is movable with the support flange of the first combustion can support assembly.

5. The lift assembly of claim 1, wherein the outer sleeve of a first combustion can support assembly of the plurality of combustion can support assemblies defines one or more slots, and wherein the inner sleeve assembly of the first combustion can support assembly of the plurality of combustion can support assemblies includes one or more threaded protrusions each extending through a respective slot of the one or more slots.

6. The lift assembly of claim 5, wherein the one or more threaded protrusions includes a compression protrusion, the compression protrusion configured to threadably engage a compression bolt, the compression bolt being oriented radially such that rotation of the compression bolt radially moves the inner sleeve assembly of the first combustion can support assembly of the plurality of combustion can support assemblies.

7. The lift assembly of claim 5, wherein the one or more threaded protrusions includes a rotation protrusion, the rotation protrusion configured to threadably engage a second jacking bolt such that rotation of the second jacking bolt moves the inner sleeve of the first combustion can support assembly of the plurality of combustion can support assemblies in the circumferential direction.

8. The lift assembly of claim 1, wherein the inner sleeve assembly of a first combustion can support assembly of the plurality of combustion can support assemblies comprises a first half cylinder and a second half cylinder movable relative to one another.

9. The lift assembly of claim 1, wherein the outer sleeve of the first combustion can support assembly of the plurality of combustion can support assemblies comprises a first wall, a second wall, and a cylindrical portion extending between the first wall and the second wall.

10. The lift assembly of claim 9, wherein the first wall and the second wall are spaced apart such that a gap is defined therebetween, and wherein a threaded bolt and nut couple the first wall to the second wall.

11. The lift assembly of claim 1, wherein the upper rail is an I-beam having a web, a first flange, and a second flange.

12. The lift assembly of claim 11, further comprising one or more lifting lugs extending from a first side of the web of the upper rail.

13. The lift assembly of claim 12, wherein the upper rail includes legs extending from a second side of the web.

14. A method of using a lift assembly, the lift assembly comprising an upper rail, a plurality of rail flanges extending from the upper rail, and a plurality of combustion can support assemblies spaced apart from one another, each combustion can support assembly of the plurality of combustion can support assemblies including a support flange slidably coupled to a rail flange of the plurality of rail flanges, an outer sleeve, and an inner sleeve assembly configured to removably couple to a combustion can of the turbomachine, wherein each combustion can support assembly of the plurality of combustion can support assemblies defines a cylindrical coordinate system having an axial direction, a radial direction, and a circumferential direction, and wherein each combustion can support assembly of the plurality of support assemblies is configured to move along each of the axial direction, the radial direction, or the circumferential direction relative to the upper rail, the method comprising:

inserting the combustion can into the inner sleeve assembly of a first combustion can support assembly of the plurality of combustion can support assemblies when the lift assembly is in a first position on a support surface;

securing the combustion can to the first combustion can support assembly by tightening the outer sleeve of the first combustion can support assembly;

moving the lift assembly to a second position in which the combustion can is positioned proximate a respective combustor assembly;

aligning the combustion can with the respective combustor assembly by moving the first combustion can support assembly relative the upper rail; and securing the combustion can to the turbomachine.

15. The method of claim 14, wherein the outer sleeve of the first combustion can support assembly comprises a first wall, a second wall spaced apart from the first wall such that a gap is defined therebetween, and a cylindrical portion extending between the first wall and the second wall, wherein a threaded bolt and nut couple the first wall to the second wall, and wherein securing the combustion can to the support assembly by tightening the outer sleeve of the first combustion can support assembly further comprises:

rotating the threaded bolt and nut to shorten the gap between the first wall and the second wall.

16. The method of claim 14, wherein the outer sleeve of the first combustion can support assembly defines one or more slots, and wherein inner sleeve of the first combustion can support assembly defines one or more threaded protrusions each extending through a respective slot of the one or more slots.

17. The method of claim 16, wherein the one or more threaded protrusions include a compression protrusion, the compression protrusion configured to threadably engage a compression bolt, the compression bolt being oriented radially with respect to an axial centerline of the first combustion can support assembly, and wherein aligning the combustion can further comprises:

rotating the compression bolt to adjust a radial position of the combustion can.

18. The method of claim 16, wherein the one or more threaded protrusions include a rotation protrusion, the rotation protrusion configured to threadably engage a second jacking bolt, and wherein aligning the combustion can further comprises:

rotating the second jacking bolt to adjust a circumferential position of the combustion can with respect to an axial centerline of the first combustion can support assembly.

* * * * *